US005810662A

United States Patent [19]

Van Becelaere

[11] Patent Number: 5,810,662

[45] Date of Patent: Sep. 22, 1998

[54] COMPACT SMOKE AND FIRE DAMPER WITH OVER CENTER LATCH

[75] Inventor: Robert M. Van Becelaere, Lake Lotawana, Mo.

[73] Assignee: Tomkins Industries, Inc., Dayton, Ohio

[21] Appl. No.: 643,781

[22] Filed: May 6, 1996

Related U.S. Application Data

[63] Continuation-in-part of Ser. No. 626,875, Apr. 3, 1996.

[51] Int. Cl.[6] ..... A62C 2/12

[52] U.S. Cl. ..... 454/369; 454/284

[58] Field of Search ..... 454/369, 284, 454/237, 339

[56] References Cited

U.S. PATENT DOCUMENTS

| | | | |
|---|---|---|---|
| Re. 30,204 | 2/1980 | Root . | |
| 251,591 | 12/1881 | Jaeger . | |
| 885,008 | 4/1908 | Beard . | |
| 1,270,412 | 6/1918 | Hedrick . | |
| 1,288,532 | 12/1918 | Drummond . | |
| 1,788,556 | 6/1931 | Wood et al. . | |
| 1,994,365 | 3/1935 | Mathews . | |
| 2,496,811 | 2/1950 | Newton . | |
| 2,869,959 | 1/1959 | Kesling . | |
| 3,273,632 | 9/1966 | McCabe . | |
| 3,327,764 | 6/1967 | McCabe . | |
| 3,525,378 | 8/1970 | Root . | |
| 3,543,440 | 12/1970 | Kurz . | |
| 3,640,307 | 2/1972 | Drzala . | |
| 3,695,105 | 10/1972 | Carlson . | |
| 3,718,081 | 2/1973 | Root . | |
| 3,996,952 | 12/1976 | Root | 454/369 |
| 4,432,272 | 2/1984 | Van Becelaere | 454/369 |
| 4,559,867 | 12/1985 | Van Becelaere et al. | 454/369 |
| 5,334,092 | 8/1994 | Binzer | 454/369 |
| 5,379,792 | 1/1995 | Van Becelaere . | |

*Primary Examiner*—Harold Joyce
*Assistant Examiner*—Derek S. Boles
*Attorney, Agent, or Firm*—Litman, McMahon & Brown L.L.C.

[57] ABSTRACT

An adjustable damper for controlling air flow between portions of a building includes a plurality of vanes positioned in a frame opening, which vanes are selectively, simultaneously rotatable between open and closed positions. A reversible motor and an actuating linkage on one side of the damper drives a first vane axle about an axis, and a vane linkage on the opposite side, rotates the other vanes along with the first vane. The actuating linkage includes a shaft which is offset from the first vane axis, which shaft is turned by the motor between open and closed positions. A linkage arm pivotally connects the shaft and the vane axle and the linkage arm is bent at an angle such that, when the shaft is rotated to the closed position, the linkage arm is rotated to an over center position in which it securely latches the vanes in a closed position. The damper, motor and drive linkage fit within a single, integrated housing which can be secured within a wall opening from a single side thereof.

18 Claims, 5 Drawing Sheets

Fig.3.
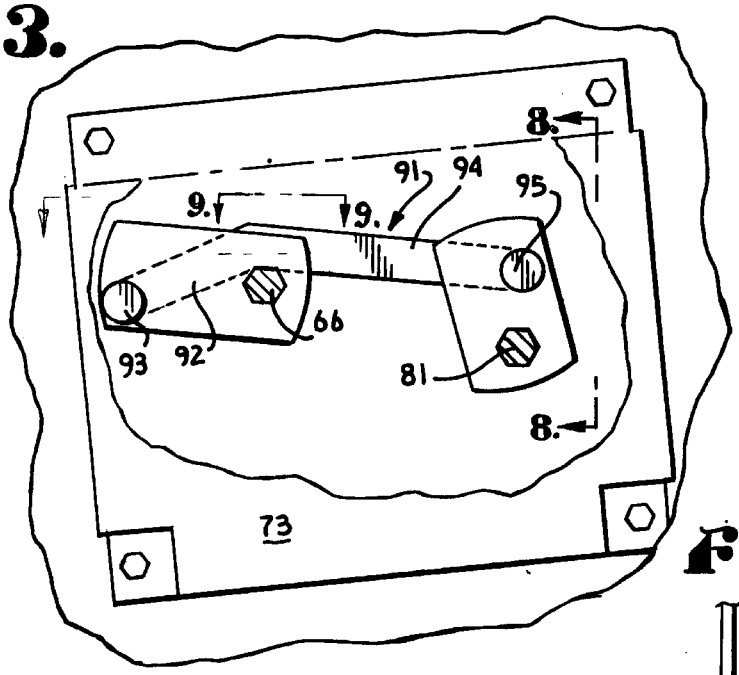
Fig.9.
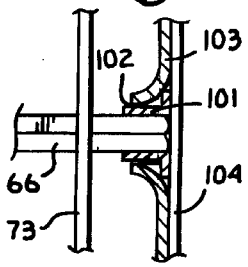
Fig.4.
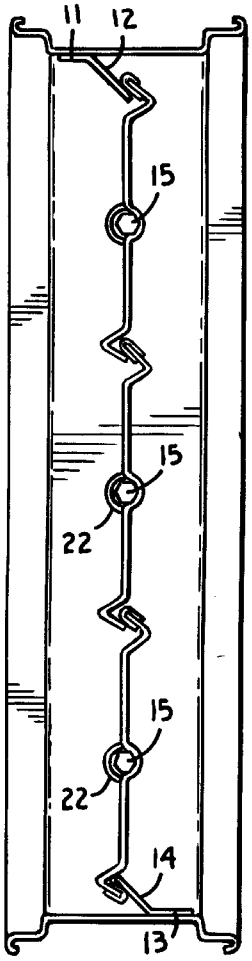
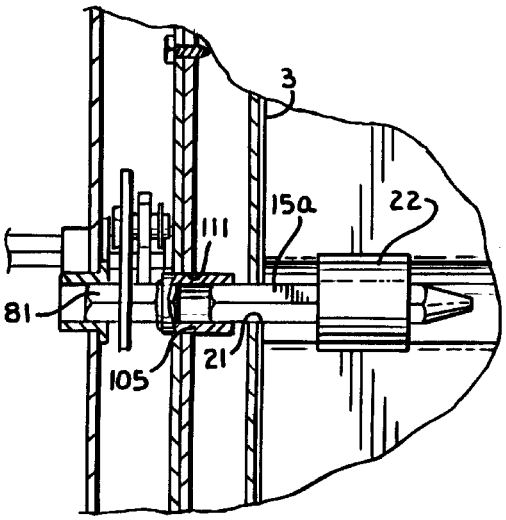
Fig.8.

COMPACT SMOKE AND FIRE DAMPER WITH OVER CENTER LATCH

CROSS-REFERENCE TO RELATED APPLICATIONS

This application is a continuation-in-part of application Ser. No. 08/626,875, filed Apr. 3, 1996, and entitled COMPACT DAMPER WITH OVER CENTER LATCH.

FIELD OF THE INVENTION

The present invention relates to a compact adjustable damper such as those used to selectively control air flow into and out of a portion of a building, such as, for example, between a hotel hallway and a hotel room or between floors in a hotel, in the event of fire or smoke. More particularly, the inventive damper includes an opening with a plurality of selectively rotatable blades or vanes positioned therein. The vanes can be rotated by a motor and connected linkage between a vertical, or closed position, at which they collectively block air flow through the opening, and a horizontal, or open position, at which they allow maximum air flow through the opening. When the blades are rotated to the closed position, an over center latch keeps them closed to prevent torsional effects from, for example, the explosive effects of a fire within the building, high pressure water from fire fighting equipment, etc. from opening the vanes. In addition, the design of the linkage allows the drive motor to be positioned at an angle in close proximity to the blade axles in an integrated housing which minimizes the overall depth of the damper. Finally, a unique design of the housing allows the damper to be secured from a single side of a wall within which it is installed.

BACKGROUND OF THE INVENTION

In many modern buildings, such as hotels and the like, fire codes require air flow control dampers to be placed in certain locations, such as between a hotel hallway and a hotel room, or to control air flow into and out of ducts extending between floors in a hotel. Such dampers are generally responsive to a smoke or fire detector to operate a motor and linkage to close off the damper. U.S. Pat. No. RE.30,204 ("the '204 patent") to James R. Root and entitled CONTROL DAMPER teaches one example of a prior art damper. Dampers such as described in the '204 patent include a generally rectangular frame designed for building into a wall. Within the rectangular frame, which defines an opening, a plurality of axles extend inward into the opening from either side. Each axle is selectively rotatable and each pair of axles has attached thereto a respective vane such that the vanes are selectively rotatable with the axles between a vertically oriented, completely closed position at which no air flow is allowed, and a horizontally oriented, completely open position at which maximum air flow is allowed. Between these extreme positions are an infinite number of intermediate, partially open positions.

In order to meet fire code regulations and to gain approval from testing agencies such as Underwriter's Laboratories (UL), such smoke and fire dampers must be latched upon closure to prevent explosive effects of a fire or high pressure water streams, for example, from opening the vanes. In the '204 patent, a latch mechanism includes a fusible portion which melts under high temperature conditions and latches the vanes closed. In addition, in all known prior art smoke and fire dampers, the UL requires that they be secured to the wall structure by supporting angle members at the top and bottom and along both sides of the damper on both the front side and the rear side of the wall structure to prevent heat and smoke from flowing around the damper. This can present a major problem where, for example, the damper is secured into an opening of a duct, which installation allows no access to the rear of the damper.

An additional problem with dampers such as that described in the '204 patent is that the fusibly linked latching mechanism requires high temperature conditions for its operation and, once melted, requires replacement of the fusible link or the damper itself. Thus, no positive latching mechanism is provided absent the presence of a high temperature fire. In addition, the '201 patent uses an operating motor and linkage which requires the motor to be positioned approximately 4"–6" away from the damper frame for adequate operating leverage. This substantially increases the overall depth of the damper, e.g. such dampers traditionally have a depth of about 18" from front to back. Furthermore, conventional dampers, such as the damper in the '201 patent, locate the motor and drive linkage outside of the sheet metal housing of the damper. This means that an installer must take special steps to separately accommodate the motor and linkage within a fire rated compartment with a separate, fire rated access door in the compartment wall.

It is clear then, that a need exists for an improved compact smoke and fire damper with movable vanes and an effective latching mechanism which causes the vanes to be reliably maintained in a closed position. The latch should be effective without melting a fusible link and should latch the vanes closed against the torsional effects of external forces acting on them. The latching mechanism should automatically unlatch as the vanes are opened and then latch as the vanes are closed. Finally, a damper which can be secured to a wall solely from the front side of the damper, which accommodates the damper, the drive motor and drive linkage in a single integrated housing, and which requires significantly less depth to install than conventional dampers, is desirable as well.

SUMMARY OF THE INVENTION

The present invention is directed to an adjustable smoke and fire damper for controlling air flow between portions of a building. The damper includes a rectangular frame forming an opening with a number of selectively rotatable axles extending from either side of the frame into the opening. A plurality of vanes are attached to respective pairs of the axles and each vane preferably is made of a flat plate bent symmetrically with opposite facing angled ends. The vanes can be made of steel plates, for example. A driven axle on one side of the frame is selectively rotated via a motor and connected actuating linkage to thereby rotate a first of the vanes and the corresponding axle on the opposing side of the frame. The axles on the opposing side of the frame are connected to a common linkage such that they rotate simultaneously with the first vane, causing their respective vanes to rotate as well. All of the vanes are thus simultaneously opened or closed together by action of the motor. The actuating linkage includes a first shaft which is offset from the driven axle, which first shaft is selectively turned by the motor via a drive shaft and lever arm. A first plate is fixedly secured to the first shaft to rotate therewith and a second plate is fixedly secured to a second shaft which is, in turn, in line with and connected to the driven axle. A linkage arm is pivotally connected at one end to the first plate at a first pivot point and at a second end to the second plate at a second pivot point. In a first, closed position of the damper, the first shaft is rotated to a first, closed position such that it causes the first plate, the linkage arm, and the second plate to fully close the vanes by rotating the driven axle and connected vane to a vertical position. In a second, open position of the damper, the first shaft is rotated to a second, open position such that it causes the first plate, the linkage arm, and the second plate to fully open the vanes by rotating the driven axle and connected vane to a horizontal position.

The linkage arm includes a first and a second leg which intersect at an angle such that, when the first shaft is rotated to the closed position, the first plate pulls the linkage arm over the top of the first shaft. The angle in the linkage arm allows the first pivot point to be pulled lower than the axes of the first shaft and the second pivot point, thus creating an over center condition for the linkage arm. In this over center condition, any forces acting on the second plate, such as those created by torsional forces on the vanes, cannot force the linkage arm to move. Thus, when the first shaft is rotated to the closed position, the relative positions of the first and second pivot point and the first shaft axes act as an over center latch mechanism to insure that forces acting on the vanes cannot force the damper open. Furthermore, the latch is automatically secured when the motor rotates the first shaft to the closed position and automatically released when the motor rotates the first shaft away from the closed position. The offset of the first shaft and the driven axle also allows the actuating motor to be placed immediately adjacent to the damper frame at an angle such that the damper, the drive motor and the drive linkage are all contained within a single, integrated housing with considerably less depth than prior art damper designs. In addition, the integrated housing is equipped with an insulating layer at the top and along both sides which allows the damper housing to be secured to a wall solely from the front side of the damper.

OBJECTS AND ADVANTAGES OF THE INVENTION

The principal objects of the present invention include: providing an improved smoke and fire damper with an over center latch; providing such a smoke and fire damper with selectively rotatable vanes which, collectively, alternatively, close off or open up air flow through the damper; providing such a smoke and fire damper with an over center latch which automatically latches the vanes closed when they are rotated to the closed position and automatically unlatches to release the vanes as they are rotated away from the closed position; providing such a smoke and fire damper in which the damper, a drive motor and drive linkage are all contained in a single, integrated housing; providing such a damper housing which is compact, i.e. with a housing with a depth which is considerably less than known fire and smoke damper designs; providing such a smoke and fire damper which can be secured in a wall opening solely from the front side of the damper; providing such a smoke and fire damper which is rugged in construction and reliable and durable in operation; and providing such a smoke and fire damper which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is an enlarged, fragmentary, cross sectional view of the damper of FIG. 1, taken along line 3—3 of FIG. 1, with portions of a cover plate broken away to illustrate the over center latch in a latched position.

FIG. 4 is a cross sectional view of the damper of FIG. 1, taken along line 4—4 of FIG. 1, and illustrating the rotatable vanes in a closed position.

FIG. 8 is an enlarged, fragmentary, cross sectional view of a portion of the damper of FIG. 1, taken along line 8—8 of FIG. 3, with portions of a rotary sleeve broken away to illustrate the interior construction thereof.

FIG. 9 is an enlarged, fragmentary, cross sectional view of a portion of the damper of FIG. 1, taken along line 9—9 of FIG. 3, with a first shaft inserted in a rotary sleeve and with portions of the rotary sleeve and a sleeve pocket broken away to illustrate the interior construction thereof.

DETAILED DESCRIPTION OF THE INVENTION

Figure 1:
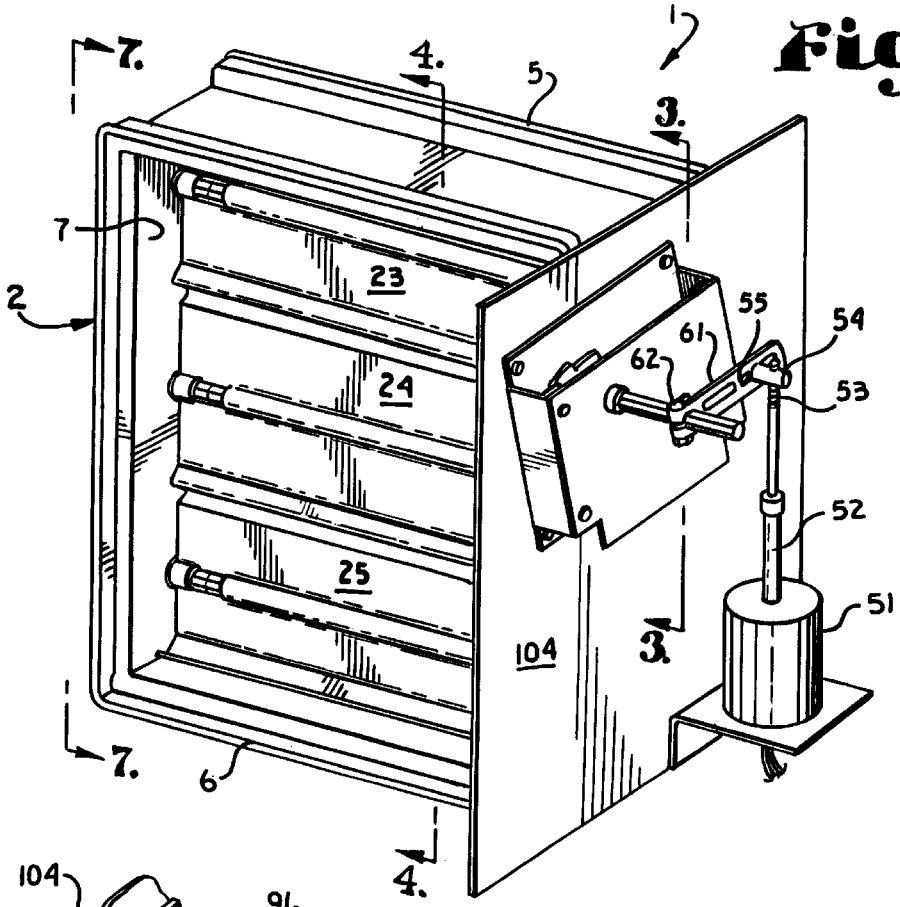
FIG. 1 is a perspective view of a first embodiment of a fire and smoke damper with over center latch in accordance with the present invention, with selectively rotatable vanes closed to block air flow therethrough.
Figure 2:
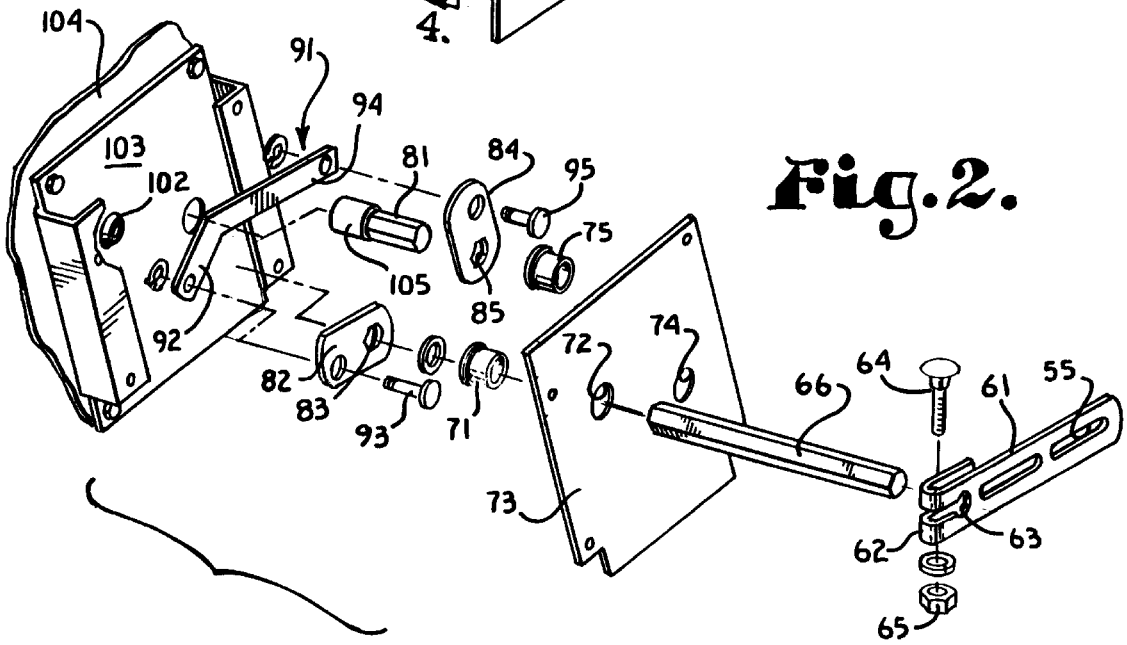
FIG. 2 is an enlarged, fragmentary, exploded view of the motor linkage for the damper of FIG. 1, illustrating the construction of the over center latch.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1–9, the reference numeral 1 generally indicates a damper in accordance with the present invention.

The damper 1 includes a generally rectangular frame 2 which is of a width which will fit within the width of a wall, such as a standard 2×4 or 2×6 stud wall, for example. The exterior of the frame 2 can be slotted along the periphery to facilitate attachment to a framed opening in the wall (not shown). The frame 2 includes side members 3 and 4 and top and bottom members 5 and 6, respectively, which collectively form a rectangular opening 7 in the frame 2. Attached inside the top member 5 is an upper flange 11 with a protruding angled leg 12 while a lower flange 13 is attached inside the bottom frame member 6 with a protruding angled leg 14. A plurality of axles 15 extend inward through bores 21 in the side frame members 3 and 4. The axles 15, which are shown as hexagonal in cross section, are arrayed in pairs opposite each other. Each axle 15 fits within a respective stationary receiving sleeve 22 on one of a plurality of rotatable vanes 23–25. The receiving sleeves 22 have an interior shape which secures the axles 15 such that the vanes are fixed with respect to the axles 15. The axles 15 are thus rotatable relative to the side frame members 3 and 4, and thus the vanes 23–25 rotate along with the axles 15.

Figure 6:
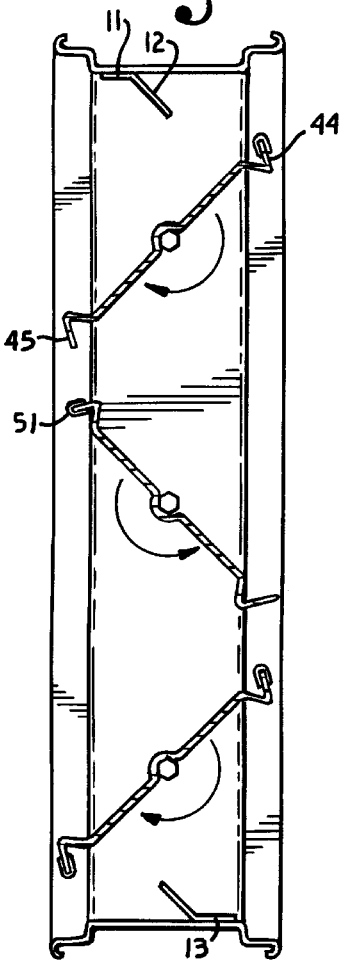
FIG. 6 is a cross sectional view of the damper of FIG. 1, taken along line 4—4 of FIG. 1, but illustrating the rotatable vanes rotated to a partially open position.
Figure 7:
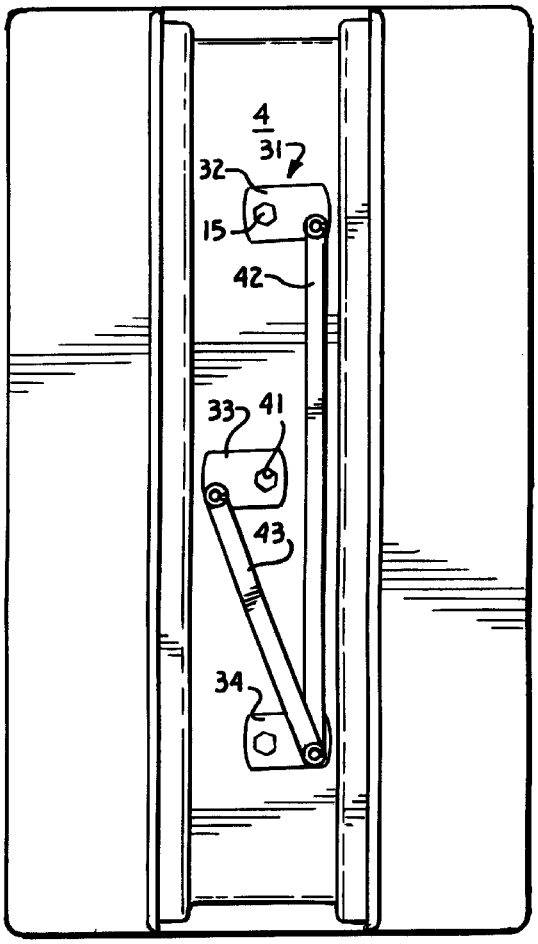
FIG. 7 is a side elevational view of the damper of FIG. 1, taken along the line 7—7 of FIG. 1 and illustrating the common linkage which causes the vanes to move simultaneously.

Referring to FIG. 7, a linkage system for simultaneously rotating the vanes 23–25 is generally indicated at 31. The linkage system 31 includes three plates 32–34, each of which has a hexagonal bore 41 sized to receive a respective axle 15 such that the axles 15 and the respective attached plate 32–34 rotate together. A first linkage arm 42 is pivotally connected at an upper end to the plate 32 and at a lower end to the plate 34. A second linkage arm 43 is pivotally connected at a lower end to the plate 34 and at an upper end to the plate 33. The effect of the connection of linkage arms 42 and 43 to the plates 32–34 is that, as any one of the vanes 23–25 rotates, the other vanes are rotated simultaneously. However, the upper and lower vanes 23 and 25 rotate in a direction opposite to the middle vane 24, as indicated by the arrows in FIG. 6.

Referring to FIGS. 4 and 6, each vane 23–25 includes upper and lower angled portions 44 and 45 which are oppositely facing. Although the vanes 24–25 are identical in construction, the upper vane 23 and the middle vane 24 have sealing gaskets 50 placed along their upper angled portions while the lower vane 25 has gaskets 50 placed along both the upper and lower angled portions 44 and 45. Thus, as the vanes 23–25 are rotated from the partially open position illustrated in FIG. 6 to the closed position illustrated in FIG. 4, the upper angled portion 44 of the upper vane 23 meshes with the upper flange 11, the upper angled portion 44 of the middle vane 24 meshes with the lower angled portion 45 of the upper vane 23, the lower angled portion 45 of the middle vane 24 meshes with the upper angled portion 44 of the lower vane 25, and the lower angled portion 45 of the lower vane 25 meshes with the lower flange 13. The vanes 23–25 and the upper and lower flanges 11 and 13, respectively, collectively seal off air flow through the opening 7 in the damper 1.

Referring particularly to FIGS. 1–3, 5, 8 and 9, the damper 1 includes a reversible actuating motor 51 which selectively extends and retracts a telescoping drive shaft 52. The motor 51 can be responsive to a fire or smoke alarm (not shown), for example, to extend the drive shaft 52. The shaft 52 has a threaded upper end 53 with a bored sleeve 54 attached thereto. The sleeve 54 is, in turn, connected to and is movable relative to a slot 55 near a first end of a lever arm 61. In the opposite end of the lever arm 61 a clamp 62 is formed with an opening 63. The clamp 62 includes a bolt 64 and nut 65 which, when tightened, clamps down the opening 63 to anchor the lever arm 61 to a first hex shaft 66. The first hex shaft 66 forms a part of an over center latch assembly 70. The assembly 70 thus includes the first hex shaft 66 extending through a sleeve 71 which fits in a bore 72 in a protective plate 73. The first hex shaft 66 is thus rotatable within the sleeve 71 by action of the motor 51. A second bore 74 in the plate 73 accommodates a second sleeve 75 with a second hex shaft 81 extending therethrough.

The assembly 70 also includes a first plate 82, which is connected to the first hex shaft 66 via a hex shaped opening 83. A second plate 84 is connected to the second hex shaft 81 via a hex shaped opening 85. The plates 82 and 84 thus rotate with their respective hex shafts 66 and 81. A linkage arm 91 is pivotally connected near one end of a first leg 92 to the first plate 82 at a first pivot pin 93. The linkage arm 91 is pivotally attached near one end of a second leg 94 to the second plate 84 at a second pivot pin 95. The linkage arm first leg 92 and the second leg 94 are angled with respect to each other, for reasons explained below.

The opposite end of the first hex shaft 66 is received in and is rotatable relative to a sleeve 101 which is rigidly secured to a stamped out bore 102 in a plate 103 (FIG. 9). The plate 103 is, in turn, attached to a larger cover plate 104 which is attached to the side frame member 3 (FIG. 8). The opposite end of the second hex shaft 81 is rigidly secured within one end of a sleeve 105 while a near end of a driven axle 15*a* is rigidly secured within the opposite end of the sleeve 105. The sleeve 105 is received within and is rotatable relative to a bore 111 extending through the plates 103 and 104. The driven axle 15*a* is connected to one of the receiving sleeves 22 on the upper vane 23 such that the upper vane 23 rotates with the axle 15*a*, the sleeve 105 and the second hex shaft 81.

Referring to FIGS. 1 and 3, the first hex shaft 66 is shown turned counterclockwise to a closed position, by enabling the motor 51 to extend the telescoping drive shaft 52. In the position shown in FIG. 3, the first plate 82 is also turned counterclockwise to the left until the linkage arm 91 rests on the first hex shaft 66 near the angled intersection between the first and second legs 92 and 94, respectively. With the linkage arm 91 in this position, due to the angle between the first and second legs 92 and 94, the first pivot pin 93 comes to rest in a position in which the axis of the first pivot pin 93 is lower than the axes of the first hex shaft 66 and the second pivot pin 95, i.e. an over center position. In this position, the vanes 23–25 are latched in place because any external torsional forces on the closed vanes 23–25 which tend toward opening the vanes, such as by fire or high pressure water streams, results in a clockwise rotational force translated to the second hex shaft 81. However, the over center position of the linkage arm 91 insures that the second plate 84 cannot be rotated since the linkage arm 91 is being pulled against itself. Thus, the second hex shaft 81 is latched in the position of FIG. 3, keeping the vanes 23–25 also latched in the closed position of FIGS. 1 and 4.

Figure 5:
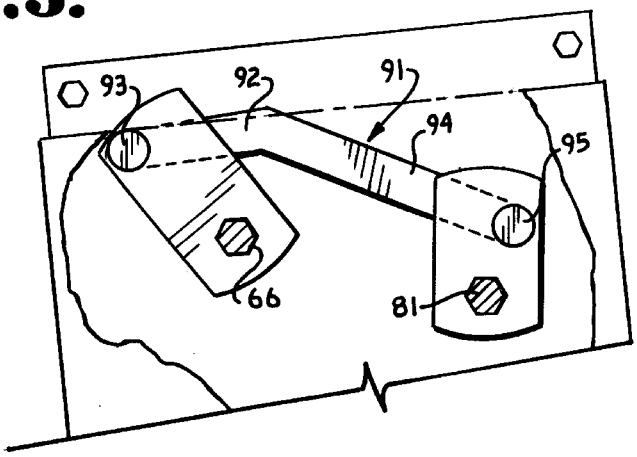
FIG. 5 is an enlarged, fragmentary, cross sectional view of the damper of FIG. 1, taken along line 3—3 of FIG. 1, with portions of a cover plate broken away to illustrate the over center latch in an unlatched position.

When the motor 51 retracts the drive shaft 52, the first ex shaft 66 is turned clockwise, as shown in FIG. 5. The linkage arm 91 is thus raised by the first plate 82 to a position in which the axis of the first pivot pin 93 is above the axes of the first hex shaft 66 and the second pivot pin 95. This ends the over center condition and the linkage arm 91 urges the second plate 84 clockwise, turning the driven axle 15*a* clockwise as well. This opens the vanes 23–25, as shown in FIG. 6. When the drive shaft 52 is fully retracted, the vanes 23–25 are placed in a horizontal position which allows maximum air flow through the opening 7 in the damper 1.

Another advantage of the present invention is the orientation of the lever arm 61 as dictated by the position of the first hex shaft 66. Since the lever arm 61 extends back toward the frame 2, the motor 51 is positioned alongside the side frame member 3. This insures that the damper 1 has as narrow a profile as possible.

Figure 10:
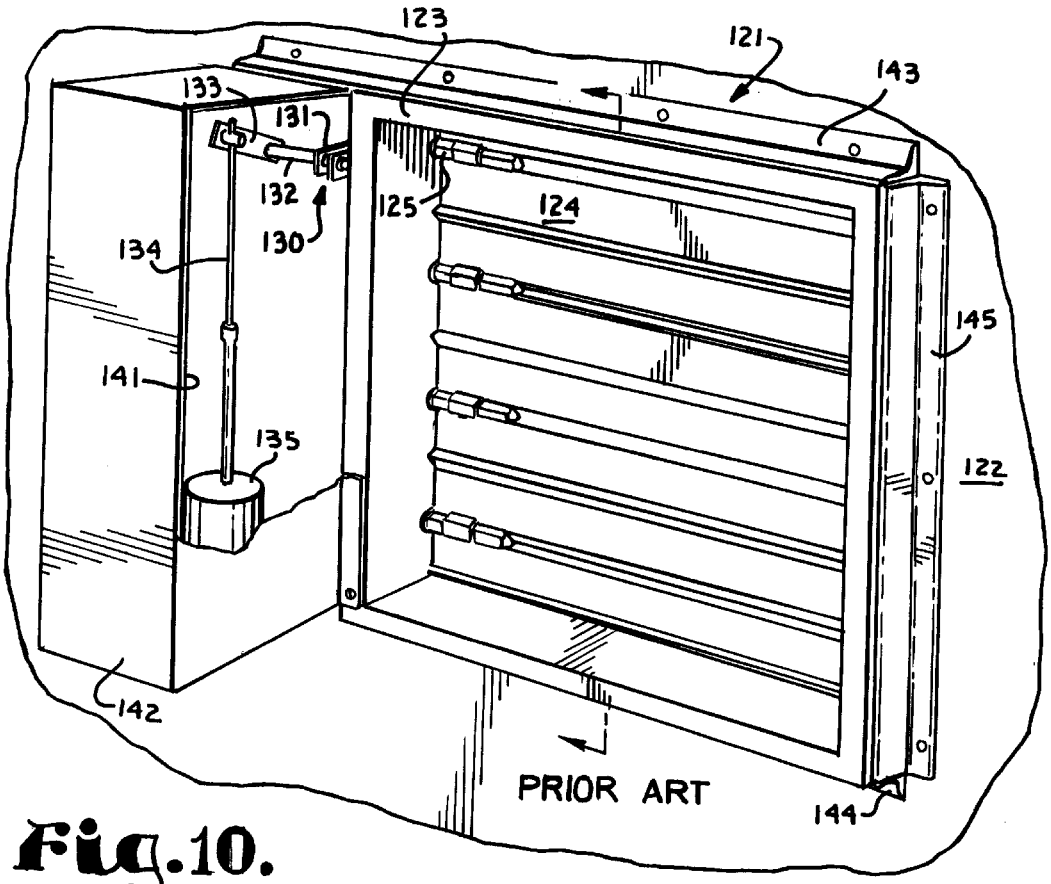
FIG. 10 is a perspective view of a prior art smoke and fire damper installed in a wall opening with a separate, dedicated compartment for the motor and linkage.
Figure 11:
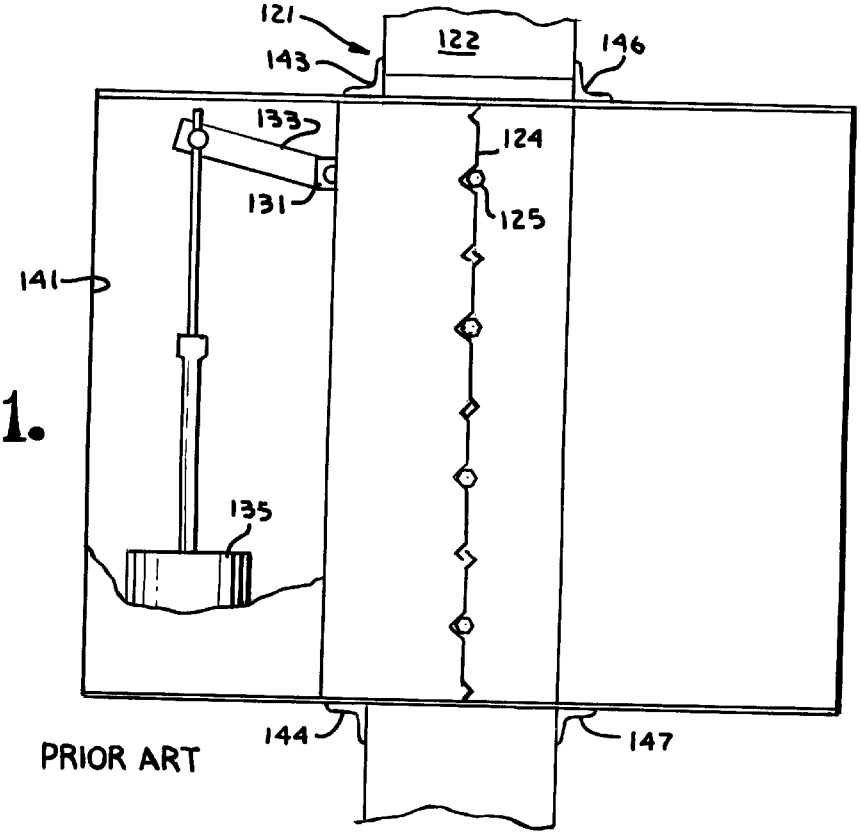
FIG. 11 is a cross-sectional view of the prior art smoke and fire damper of FIG. 10, taken along line 11—11 of FIG. 10 and illustrating the installation attachment requirements of the prior art.

FIGS. 10 and 11 illustrate a prior art smoke and fire damper, generally indicated at 121, installed in a wall 122. The damper 121 includes a conventional damper frame 123 with a plurality of movable vanes 124. The vanes are linked by a common linkage (not shown) such that they open or close simultaneously. The uppermost vane 124 is connected to a rotary axle 125 which is driven by a drive linkage assembly, generally indicated at 130. The drive linkage assembly 130 includes an arm 131, a first end of which is rigidly attached to the axle 125. The opposite end of the arm 131 is pivotably connected to one end of an offset shaft 132, with the other end of the shaft 132 being rigidly attached to one end of a lever arm 133. The other end of the lever arm 133 is attached to an upper end of a telescoping drive shaft 134 driven by a drive motor 135. In operation, as the drive shaft 134 is extended and retracted by the motor 135, the linkage assembly 130, including the lever arm 133, the offset shaft 132, and the arm 131, act together as a single lever, causing the axle 125 to be selectively rotated to close or open the uppermost vane 124, as well as all of the connected vanes 124. The mechanism illustrated in FIGS. 10 and 11 is similar to that taught by the '204 patent mentioned earlier.

A problem with the conventional, unified lever arrangement of FIG. 10 is the pronounced offset required for placement of the motor 135 in order to effectively drive the vanes 124. Conventionally, smoke and fire dampers such as the damper 121 illustrated in FIGS. 10 and 11, have a minimum overall depth of approximately 18 inches. This presents problems in installation of the damper 121 since accommodations must be made for the motor 135 and associated drive linkage separate from the frame 123. This typically entails the construction of a separate compartment, such as the compartment 141, to hold the motor 135 and drive linkage 130. Also, a separate, fire rated access door 142 must be installed to access the compartment 141. In the installation of FIG. 10, the motor 135 and linkage assembly 130 protrude forward of the damper frame 123, thus necessitating the compartment 141 to be built out from the wall 122. Of course, the damper 121 can be installed in a reverse fashion, requiring the motor 135 to be inset from the wall 122 to the same extent. In either case, an additional compartment 141 must be provided to house the motor 135 and linkage assembly 130.

An additional problem with prior art smoke and fire dampers, such as the damper 121, is illustrated in FIG. 11. Heretofore, testing agencies, such as UL, in order to prevent the passage of smoke or fire around dampers such as the damper 121, have required that such dampers be secured within a wall opening along the top and bottom and both sides of the damper on both the front and the rear side of the damper. Thus, top and bottom angle support members 143 and 144 and side angle support members 145 must be provided to attach the front side of the damper 121 to the front side of the wall 122 while additional top and bottom angle support members 146 and 147 and side angle support members (not shown) must be provided to attach the rear of the damper 121 to the back side of the wall 122. This is particularly problematical when the damper 121 opens into an interior duct which prevents access to the back side of the wall 122.

Figure 12:
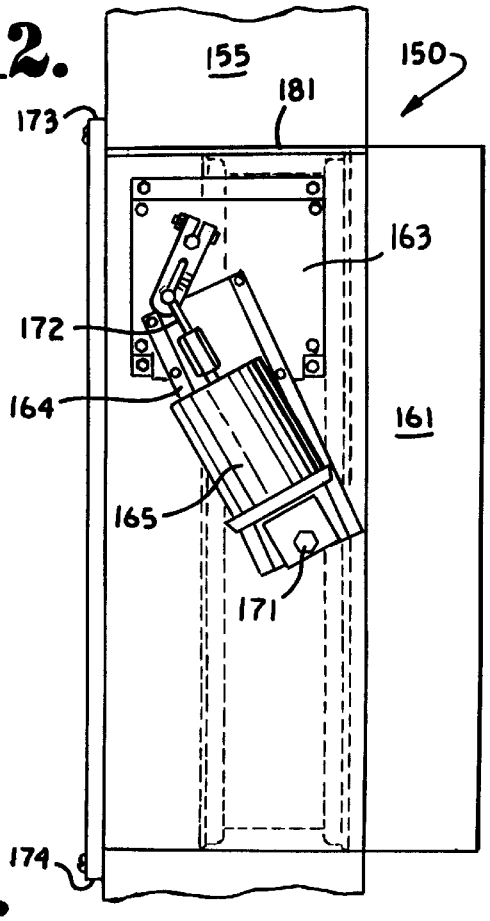
FIG. 12 is a perspective view of an alternative embodiment of the inventive smoke and fire damper, illustrating the drive motor oriented at an angle and the linkage oriented to minimize overall damper depth and with the damper, drive motor and drive linkage contained within a single, integrated housing, insulated along the top and both sides of the damper housing.
Figure 13:
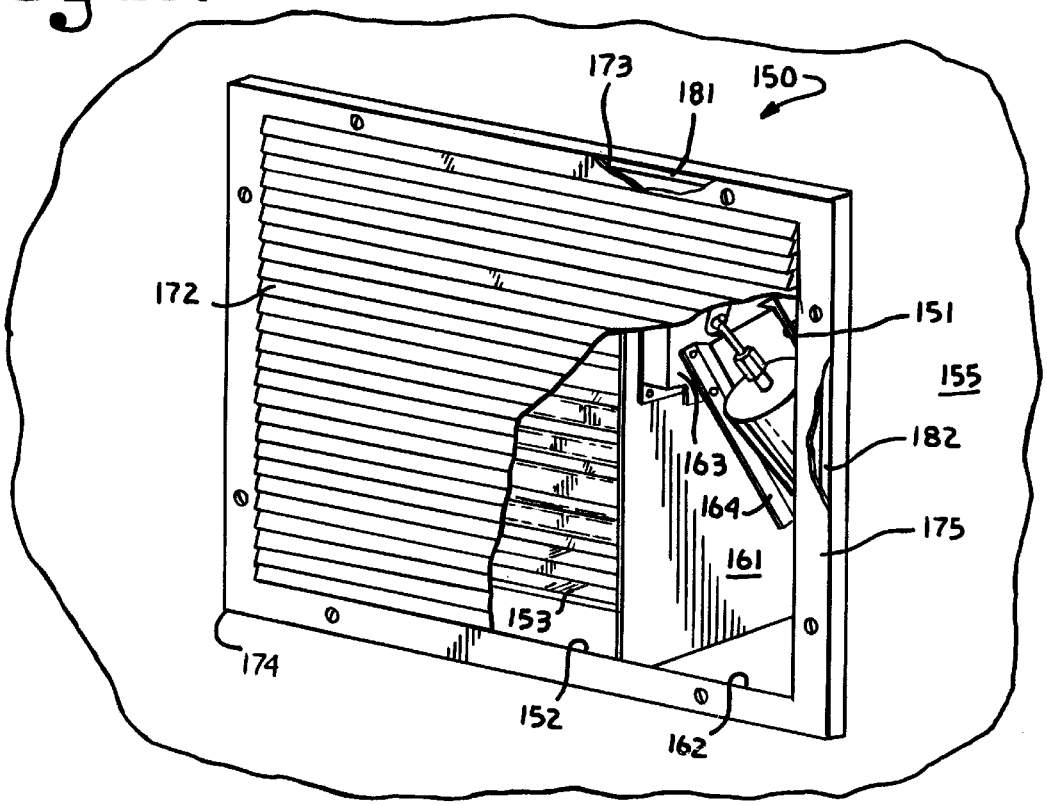
FIG. 13 is a cross-sectional view of the inventive smoke and fire damper of FIG. 12, taken along line 13—13 of FIG. 12 and illustrating the attachment of the inventive damper to a wall solely from the front side of the damper as well as the minimized overall depth of the present invention.

FIGS. 12 and 13 illustrate an alternative embodiment of the inventive smoke and fire damper, generally indicated at 150. The damper 150 is virtually identical in construction to the damper 1 illustrated in FIGS. 1–9, but is designed to have a minimum front to back depth, e.g. typically on the order of 12 inches in overall depth as compared to 18 inches in the prior art. The damper 150 includes a unitary rectangular housing 151 which contains a damper section 152 with a plurality of movable vanes 153 positioned to selectively open or close an opening in a wall 155. The vanes 153 extend between a pair of side walls, of which only wall 161 is illustrated, and the walls 161 extend beyond the wall 155 so as to mate with interior duct work or the like.

The housing 151 also includes a motor and drive linkage section 162 within which is positioned an over center latch assembly 163 which is essentially identical to the assembly 70 in FIGS. 1–9, and will thus not be further described here. The assembly 163 is attached to the side wall 161 and is distinguished from the assembly 70 in FIGS. 1–9 in that it is positioned in an upright manner so as to occupy a minimum space from front to back of the damper 150.

In order to further minimize, the depth of the damper 150, a motor mounting plate 164 is attached to the assembly 163 and to the right side wall 161, with the plate 164 mounted at an angle with respect to vertical. A motor 165 is pivotably attached to the plate 164 via a bolt 171. The motor 165 selectively extends a drive shaft 172 to operate the over center assembly 163, thus opening and closing, and locking the vanes 153, as described above with respect to FIGS. 1–9. However, the pivotable motor 165 mounted at the angle shown acts the motor 165 to be mounted immediately adjacent to the movable vanes 153 while still providing sufficient leverage to operate the over center latch assembly 163. This design allows the motor 165 and drive linkage including the over center latch assembly 163 to be incorporated into the compartment 162 of the housing 151. This also allows the damper 150 to be essentially flush mounted to the wall 161 and covered with an integral decorative grill 172, which avoids the necessity of constructing a separate, fire rated motor compartment 141, as in the prior art damper 121 of FIGS. 10 and 11.

FIG. 12 illustrates a further advantage of the inventive damper 150 which has been UL approved to require only top and bottom angle support members 173 and 174 and side support members 175 instead of angle support members on both sides of the damper, such as the support members 143–147, as shown in FIGS. 10 and 11. This avoids the requirement of accessing the rear of the damper 150 within hidden portions behind the wall 155, such as when the damper 150 is inserted into a duct (not shown) behind the wall 155. The UL approval was gained via the insertion of ceramic fiber insulation layers 181 and 182 along the top and both sides of the damper 150 which collectively prevent the passage of smoke and/or fire around the tops and sides of the damper 150, which was a major concern in prior art smoke and fire dampers such as the damper 121.

While the inventive dampers 1 and 150 have been illustrated and described as being of use as a smoke and fire damper, but they could be equally useful in other applications, such as for an external air vent for an HVAC system, for example, or for controlling any opening where fluid flow needs to be regulated. While the damper 1 has been illustrated with vanes 23–25 constructed of flat plates, other shapes, such as airfoil shaped vanes, can be used as well. For use as a fire damper, some type of failsafe closure, such as a combination fusible link and spring closure, shown in the '204 patent, could be incorporated to insure that the vanes 23–25 are rotated to the closed, latched position in the event of fire.

It is thus to be understood that while certain forms of the present invention have been illustrated and described herein, it is not to be limited to the specific forms or arrangement of parts described and shown.

What is claimed and desired to be secured by Letters Patent is as follows:

1. A damper comprising:

a. a frame forming an opening;

b. a first vane in said opening, said first vane being supported by a rotatable axle such that it is selectively movable between a closed position substantially blocking at least a portion of said opening and an open position allowing maximum fluid flow through said opening c. an operating linkage assembly connected to said first rotatable axle, said linkage assembly including:

i. first and second shafts offset with respect to each other, said first shaft being connected to said axle;

ii. a rigid one piece angled linkage arm connecting said first and said second shafts such that, when said second shaft is rotated, said first shaft is caused to rotate by said linkage arm, said linkage arm including first and second legs with a first end terminating said first leg and a second end terminating said second leg, said first and second legs being oriented at an angle with respect to each other such that, when said vane is in said open position, said first end is rotated to a higher position than the axis of said first shaft and, when said vane is in said closed position, said first end is rotated to a lower position than the axis of said first shaft to assume an over center, latched condition; and d. a motor connected to selectively rotate said first shaft.

2. A damper as in claim 1, and further comprising:

a. a first plate connected to rotate with said first shaft, said first plate being pivotally connected to said linkage arm at a first pivot point proximate said first end; and b. a second plate connected to rotate with said first shaft, said second plate being pivotally connected to said linkage arm at a second pivot point proximate said second end such that;

c. as said second shaft is rotated, said linkage arm is moved between closed and open positions, thus rotating said first shaft and said axle.

3. A damper as in claim 1, and further comprising:

a. a lever arm with one end connected to said second shaft; and b. a drive shaft connected to said motor and being selectively extendable and retractable via said motor, said lever arm having an opposite end connected to said drive shaft such that said second shaft is selectively caused to rotate as said drive shaft is extended and retracted.

4. A damper as in claim 3, wherein:

a. said motor and said drive shaft are pivotably attached to said damper frame proximate said linkage assembly at an angle with respect to vertical.

5. A damper as in claim 1, and further comprising:

a. one or more additional vanes in said opening, each of said additional vanes being selectively movable between a closed position substantially blocking a portion of said opening and an open position allowing maximum fluid flow through said opening; and b. a vane linkage system which links said first vane with said additional vanes such that said additional vanes are moved between said closed and open positions simultaneously with said first vane, said first vane and said additional vanes cooperatively blocking off said opening when in said closed position.

6. A damper as in claim 1, and further comprising:

a. an integral housing with a first compartment housing said vanes and a second compartment housing said motor and linkage assembly.

7. A damper as in claim 6, and further comprising:

a. an insulation layer positioned along the top and sides of said housing.

8. A damper comprising:

a. a frame forming an opening;

b. a first vane in said opening, said first vane being supported by a rotatable axle such that it is selectively movable between a closed position substantially blocking at least a portion of said opening and an open position allowing maximum fluid flow through said opening; and c. an operating linkage assembly connected to said first vane, said linkage assembly including:

i. first and second shafts offset with respect to each other, said first shaft being connected to said axle;

ii. a rigid one piece angled linkage arm connecting said first and said second shafts such that, when said second shaft is rotated, said first shaft is caused to rotate by said linkage arm, said linkage arm including first and second legs with a first end terminating said first leg and a second end terminating said second leg, said first and second legs being oriented at an angle with respect to each other such that, when said vane is in said open position, said first end is rotated to a higher position than the axis of said first shaft and, when said vane is in said closed position, said first end is rotated to a lower position than the axis of said first shaft to assume an over center, latched condition; and iii. a lever arm with one end connected to said second shaft;

d. a motor;

e. a drive shaft connected to said motor and being selectively extendable and retractable via said motor, said lever arm having an opposite end connected to said drive shaft such that said second shaft is selectively caused to rotate as said drive shaft is extended and retracted; and wherein f. said motor and said drive shaft are pivotably attached to said damper frame proximate said linkage assembly at an angle with respect to vertical.

9. A damper as in claim 8, and further comprising:

a. a first plate connected to rotate with said first shaft, said first plate being pivotally connected to said linkage arm at a first pivot point proximate said first end; and c. a second plate connected to rotate with said first shaft, said second plate being pivotally connected to said linkage arm at a second pivot point proximate said second end such that;

d. as said second shaft is rotated, said linkage arm is moved between closed and open positions, thus rotating said first shaft and said axle.

10. A damper as in claim 8, and further comprising:

a. one or more additional vanes in said opening, each of said additional vanes being selectively movable between a closed position substantially blocking a portion of said opening and an open position allowing maximum fluid flow through said opening; and b. a vane linkage system which links said first vane with said additional vanes such that said additional vanes are moved between said closed and open positions simultaneously with said first vane, said first vane and said additional vanes cooperatively blocking off at least a portion of said opening when in said closed position.

11. A damper as in claim 8, and further comprising:

a. an integral housing with a first compartment housing said vanes and a second compartment housing said motor and linkage assembly.

12. A damper as in claim 11, and further comprising:

a. an insulation layer positioned along the top and sides of said housing.

13. A damper comprising:

a. a frame forming an opening;

b. a first vane in said opening, said first vane being supported by a rotatable axle such that it is selectively movable between a closed position substantially blocking at least a portion of said opening and an open position allowing maximum fluid flow through said opening;

c. an operating linkage assembly connected to said first vane, said linkage assembly including:

i. first and second shafts offset with respect to each other, said second shaft being connected to said axle;

ii. a rigid one piece angled linkage arm connecting said first and said second shafts such that, when said second shaft is rotated, said first shaft is caused to rotate by said linkage arm, said linkage arm including first and second legs with a first end terminating said first leg and a second end terminating said second leg, said first and second legs being oriented at an angle with respect to each other such that, when said vane is in said open position, said first end is rotated to a higher position than the axis of said first shaft and, when said vane is in said closed position, said first end is rotated to a lower position than the axis of said first shaft to assume an over center, latched condition; and iii. a lever arm with one end connected to said first shaft;

d. a motor;

e. a drive shaft connected to said motor and being selectively extendable and retractable via said motor, said lever arm having an opposite end connected to said drive shaft such that said second shaft is selectively caused to rotate as said drive shaft is extended and retracted; and wherein f. said motor and said drive shaft are pivotably attached to said damper frame proximate said linkage assembly at an angle with respect to vertical; and g. an integral housing with a first compartment housing said frame and a second compartment housing said motor and linkage assembly.

14. A damper as in claim 13, and further comprising:

a. a first plate connected to rotate with said first shaft, said first plate being pivotally connected to said linkage arm at a first pivot point proximate said first end; and b. a second plate connected to rotate with said first shaft, said second plate being pivotally connected to said linkage arm at a second pivot point proximate said second end such that;

c. as said second shaft is rotated, said linkage arm is moved between closed and open positions, thus rotating said first shaft and said axle.

15. A damper as in claim 13, and further comprising:

a. one or more additional vanes in said opening, each of said additional vanes being selectively movable between a closed position substantially blocking a portion of said opening and an open position allowing maximum fluid flow through said opening; and b. a vane linkage system which links said first vane with said additional vanes such that said additional vanes are moved between said closed and open positions simultaneously with said first vane, said first vane and said additional vanes cooperatively blocking off at least a portion of said opening when in said closed position.

16. A damper as in claim 13, and further comprising:

a. an insulation layer positioned along the top and sides of said housing.

17. A method of installing a fire and smoke damper into an opening in a wall, said damper including a frame including a plurality of movable vanes, a drive motor and a linkage assembly including a drive shaft linking said drive motor to said vanes such that said vanes are selectively opened and closed as said drive shaft is extended and retracted, said method including the steps of:

a. placing said frame, said motor and said linkage assembly into an integral housing;

b. providing a layer of insulating material along the top and both sides of said housing;

c. placing said housing into said wall opening; and d. attaching said housing to said wall solely from a front side of said damper via a plurality of angle support members.

18. A method as in claim 17, and further comprising the steps of:

a. providing two separate compartments in said housing;

b. placing said frame and vanes in a first of said compartments; and c. placing said motor and linkage assembly in the second of said compartments.

* * * * *